US005537123A

United States Patent [19]

Mandai et al.

[11] Patent Number: 5,537,123

[45] Date of Patent: Jul. 16, 1996

[54] ANTENNAS AND ANTENNA UNITS

[75] Inventors: Harufumi Mandai, Osaka; Teruhisa Tsuru, Kyoto, both of Japan

[73] Assignee: Murata Manufacturing Co., Ltd., Japan

[21] Appl. No.: 398,325

[22] Filed: Mar. 3, 1995

[30] Foreign Application Priority Data

Mar. 10, 1994 [JP] Japan ..... 6-040054

[51] Int. Cl.[6] ..... H01Q 1/26

[52] U.S. Cl. ..... 343/700 MS; 343/749; 343/846; 343/848

[58] Field of Search ..... 343/700 MS, 702, 343/749, 846, 848

[56] References Cited

U.S. PATENT DOCUMENTS

| | | | |
|---|---|---|---|
| 3,244,981 | 4/1966 | Tatevasian | 343/702 |
| 4,876,552 | 10/1989 | Zakman | 343/702 |
| 5,113,196 | 5/1992 | Ponce de Leon et al. | 343/702 X |
| 5,148,181 | 9/1992 | Yokoyama et al. | 343/700 MS X |
| 5,184,143 | 2/1993 | Marko | 343/702 X |
| 5,200,756 | 4/1993 | Feller | 343/846 X |
| 5,291,210 | 3/1994 | Nakase | 343/700 MS |
| 5,406,292 | 4/1995 | Schnetzer et al. | 343/700 MS |

FOREIGN PATENT DOCUMENTS

| | | | |
|---|---|---|---|
| 2067842 | 7/1981 | United Kingdom | 343/700 MS |

*Primary Examiner*—Donald T. Hajec
*Assistant Examiner*—Tho Phan
*Attorney, Agent, or Firm*—Majestic, Parsons, Siebert & Hsue

[57] ABSTRACT

An antenna is formed by attaching a metallic chassis to a dielectric base plate on which are formed an input electrode, a connector electrode and grounding areas. The metallic chassis has a planar part serving as its radiating part and attachment parts formed by bending mutually opposite edge parts of this planar part substantially perpendicularly thereto, and the input electrode, the connector electrode and one of the grounding areas are each connected to either of the attachment parts. An antenna unit is formed by mounting the metallic chassis of such an antenna inside an opening formed in a printed circuit board on which are formed a feed electrode and grounding electrodes formed with an edge portion of each abutting this opening and by connecting the input electrode to the feed electrode, and the grounding electrode to one of the grounding areas.

19 Claims, 3 Drawing Sheets

ANTENNAS AND ANTENNA UNITS

BACKGROUND OF THE INVENTION

This invention relates to antennas and antenna units used for mobile communication systems.

An example of prior art microstrip antenna, for use in a mobile communication system such as a car radio, is shown generally at 35 in FIGS. 6A and 6B wherein numeral 31 indicates a dielectric base plate with a patch electrode 32 and a shielding electrode 33 formed on its surfaces. A connector 34 with an inner conductor and an outer conductor is attached to the same side of the base plate 31 as the shielding electrode 33, with the inner conductor connected to a feed point 32*a* of the patch electrode 32 and the outer conductor connected to the shielding electrode 33. Electromagnetic waves are received and transmitted through the patch electrode 32 such that the functions of an antenna can be carried out.

If one attempts to reduce the outer dimensions of the base plate 31 in order to produce a compact microstrip antenna, however, its antenna characteristics will be adversely affected. For this reason, it was not possible as a practical matter to reduce the length of the patch electrode to less than one-tenth of the wavelength. Because the connector 34 protrudes from the bottom surface, furthermore, the overall height of the microstrip antenna 35 could not be reduced beyond a certain limit for easy surface-mounting of the antenna.

SUMMARY OF THE INVENTION

It is therefore an object of the present invention to eliminate such problems of prior art microstrip antenna technology by providing antennas and antenna units having a compact base plate with high capabilities and having only a small protrusion therefrom.

A microstrip antenna embodying the present invention, with which the above and other objects can be accomplished, may be characterized as comprising not only a dielectric base plate on which are formed an input electrode, a connector electrode and grounding areas but also a metallic chassis having a planar part and attachment parts formed by bending mutually opposite edge parts of the planar part substantially perpendicularly thereto and attached to the base plate such that the input electrode, the connector electrode and one of the grounding areas are each connected to either of these attachment parts. An antenna unit embodying the present invention may be characterized as having the metallic chassis of an antenna, as described above, being mounted inside an opening formed in a printed circuit board on which are formed a feed electrode and grounding electrodes formed with an edge portion of each abutting this opening. The input electrode is connected to the feed electrode, and the grounding electrode is connected to the grounding area.

Because a metallic chassis is used as the radiating part of the antenna, not only is the resistance of the antenna reduced, but also its capacity is increased and its Joule loss is reduced, thereby increasing its gain. Since the antenna is surface-mounted to a printed circuit board by inserting its metallic chassis into an opening formed in the circuit board, furthermore, the height by which the antenna protrudes from the circuit board can be reduced.

Since the input electrode of the antenna and the ground is connected through a part of the metallic chassis, an inductance is generated therebetween, and the impedance of the antenna can be adjusted easily by adjusting this inductance, say, for impedance matching with an external circuit.

BRIEF DESCRIPTION OF THE DRAWINGS

The accompanying drawings, which are incorporated in and form a part of this specification, illustrate an embodiment of the invention and, together with the description, serve to explain the principles of the invention. In the drawings.

DETAILED DESCRIPTION OF THE INVENTION

Figure 1:
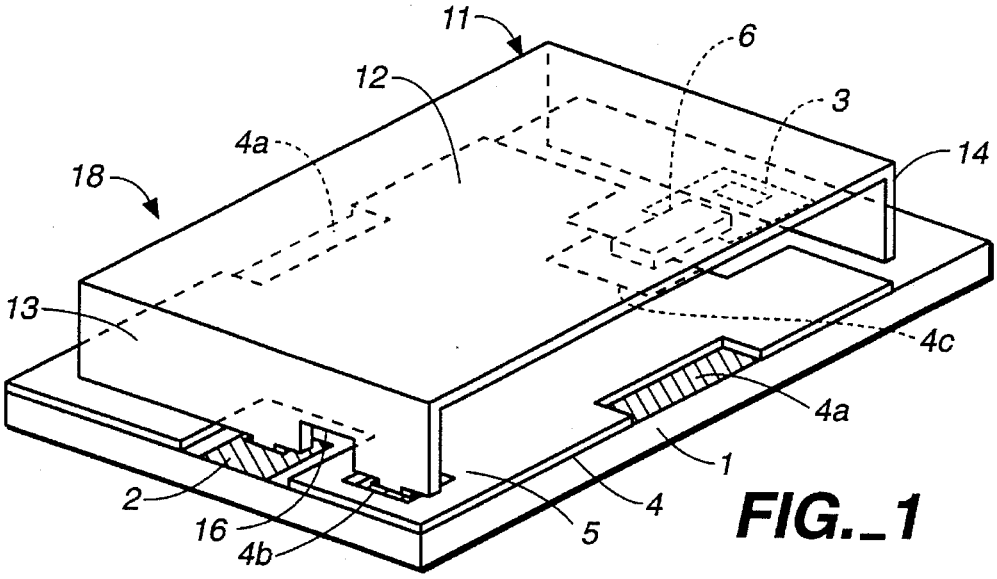
FIG. 1 is a diagonal view of an antenna embodying the invention.
Figure 2:
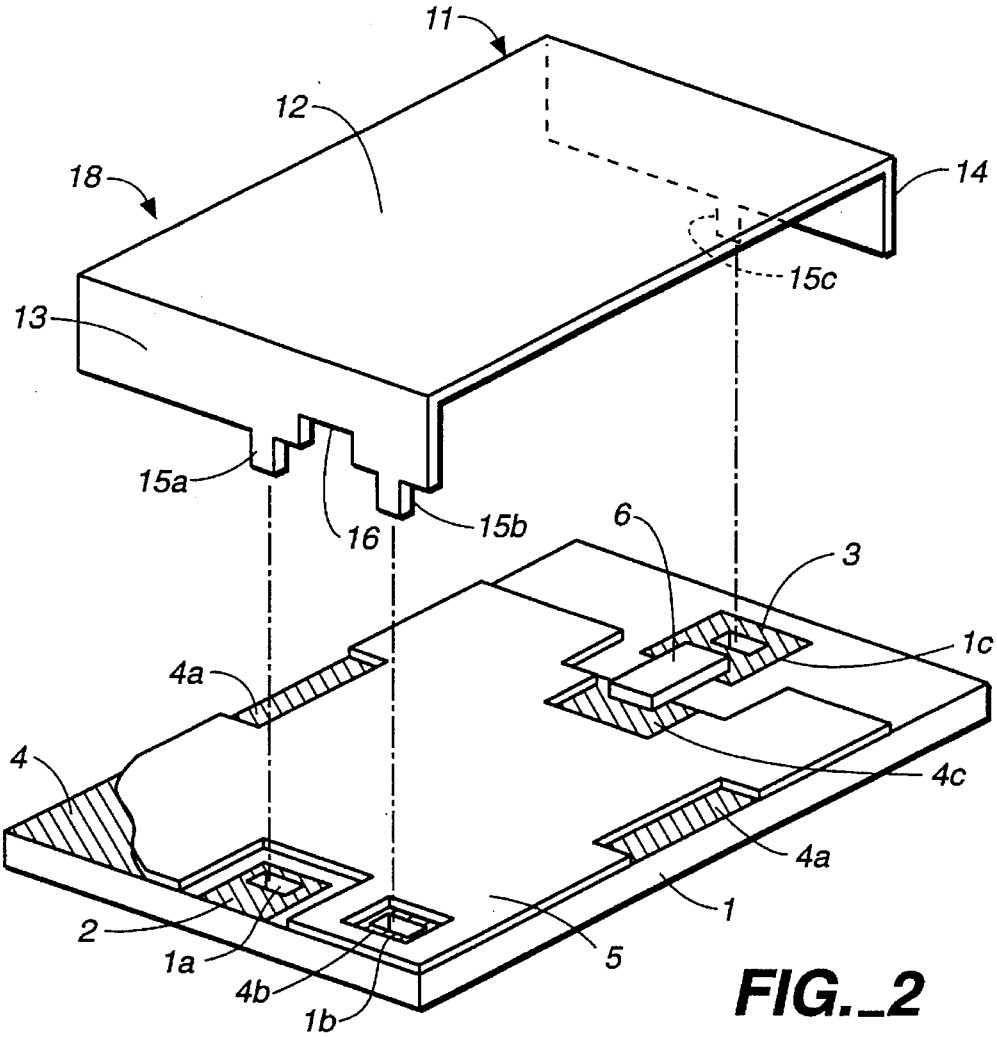
FIG. 2 is a diagonal exploded view of the antenna of FIG. 1.

FIGS. 1 and 2 show an antenna 18 embodying the present invention comprising a rectangular dielectric base plate 1 with throughholes 1*a*, 1*b* and 1*c* formed therethrough near its shorter edges. An input electrode 2 and a connector electrode 3 are formed around the throughholes 1*a* and 1*c*, respectively, on the base plate 1. A grounding conductor 4 is also formed on the base plate 1, separated from the input electrode 2 and the connector electrode 3. Solder resist ink 5 is applied over a large portion of the grounding conductor 4, leaving portions of the grounding conductor 4 exposed to form ground-connecting areas 4*a*, 4*b* and 4*c*(herein referred to as grounding areas) along the two longer edges of the base plate 1, around the throughhole 1*b*, and on the opposite side of the connector electrode 3, respectively. A chip capacitor 6 is connected between the connector electrode 3 and the connecting area 4*c*.

Numeral 11 indicates a metallic chassis made, for example, of copper or a copper alloy. It has a planar rectangular radiating part 12 and two planar attachment parts 13 and 14 formed by bending the two shorter edge portions of the radiating part 12 perpendicularly thereto. The attachment part 13 has two protrusions 15*a* and 15*b* formed unistructurally therewith, and the other attachment part 14 has one protrusion 15*c* formed unistructurally therewith. An indentation 16 is formed on the edge of the attachment part 13 between its two protrusions 15*a* and 15*b*. These protrusions 15*a*, 15*b* and 15*c* and throughholes 1*a*, 1*b* and 1*c* are formed correspondingly with respect to each other such that the metallic chassis 11 can be attached to the base plate 1 by inserting the three protrusions 15*a*, 15*b* and 15*b* respectively into the throughholes 1*a*, 1*b* and 1*c* and soldering the input electrode 2, the connecting area 4*b* and the connector electrode 3 with the attachment parts 13 and 14.

An antenna thus structured has the advantage of having smaller resistance because a metallic radiating part 12 is used for transmission and reception of electromagnetic waves. It has an improved gain because its large heat capacity reduces its Joule loss.

Figure 3:
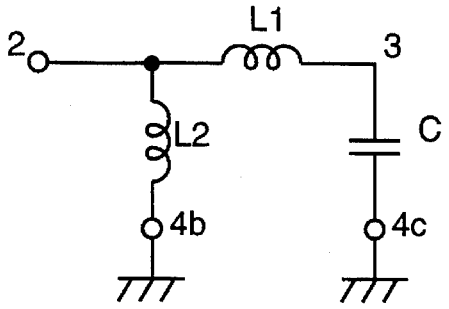
FIG. 3 is an equivalent circuit diagram of the antenna of FIG. 1.

As shown in FIG. 3, which is an equivalent circuit diagram of the antenna 18, it may be considered to comprise inductance $L_1$ and $L_2$ and capacitance C, where the inductance $L_1$ is primarily that of the radiating part 12 of the metallic chassis 11 and $L_2$ is the inductance between the input electrode 2 and the connecting area 4*b*, or primarily between the protrusions 15*a* and 15*b* of the attachment part 13 of the metallic chassis 11. The capacitance C is primarily that of the chip capacitor 6 connected between the connector electrode 3 and the connecting area 4*c*. Impedance matching of the antenna 18 with an external circuit can be carried out easily by changing the impedance of the antenna 18 by varying the dimensions of the indentation 16 such as its width and depth to thereby change the magnitude of the inductance $L_2$ and to adjust the ratio between $L_1$ and $L_2$.

Figure 4A:
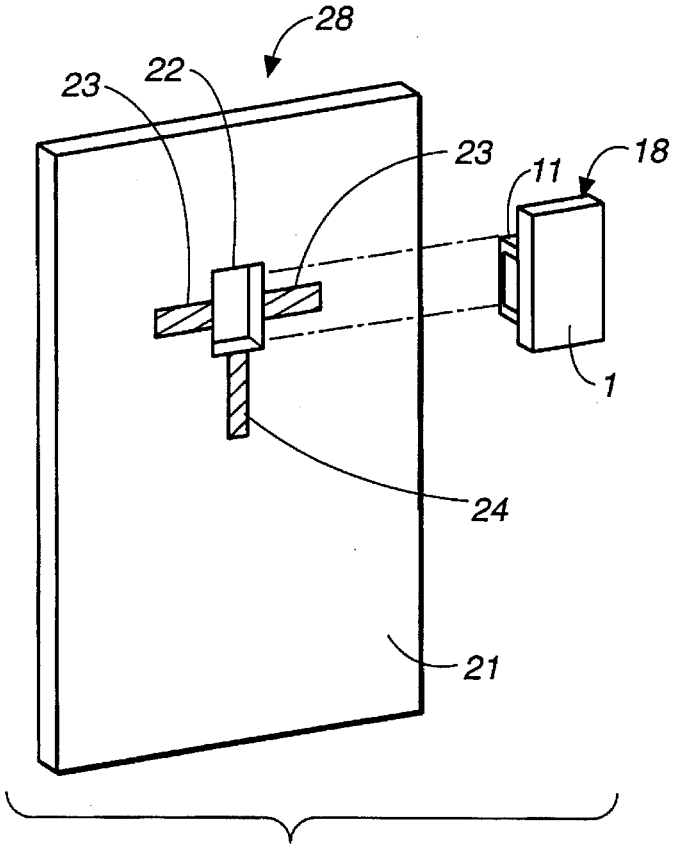
FIG. 4A is a diagonal exploded view of an antenna unit embodying the invention and FIG. 4B is a sectional view of the antenna unit of, FIG. 4A when it is assembled.
Figure 4B:
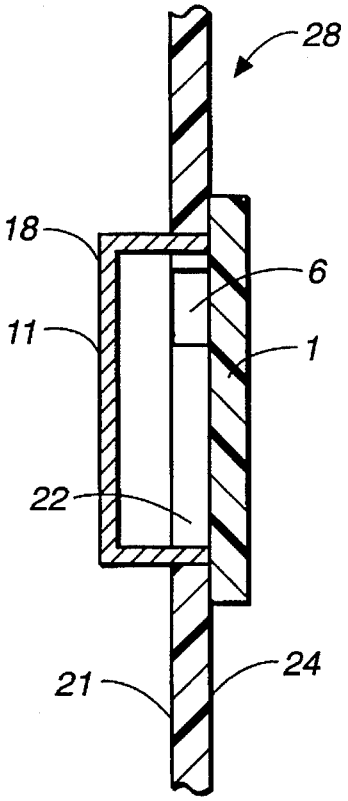

FIGS. 4A and 4B show an electronic component (referred to as an antenna unit) incorporating an antenna embodying this invention and comprising a printed circuit board 21 having an opening 22 therethrough which is larger than the external contour of the metallic chassis 11 of the antenna 18. A pair of grounding electrodes 23 is formed on a front surface thereof with one edge abutting the opening 22, and a feed electrode 24 is formed on the same surface with one edge abutting a portion of the opening 22 where the grounding electrodes 23 are not formed.

After the metallic chassis 11 of the antenna 18 is inserted into the opening 22 in the printed circuit board 21, the input electrode 2 of the antenna 18 is soldered to the feed electrode 24 of the printed circuit board 21, and the connecting areas 4*a* of the antenna 18 are soldered to the grounding electrodes 23 on the printed circuit board 21 to complete a surface-mounted antenna unit 28.

Figure 5:
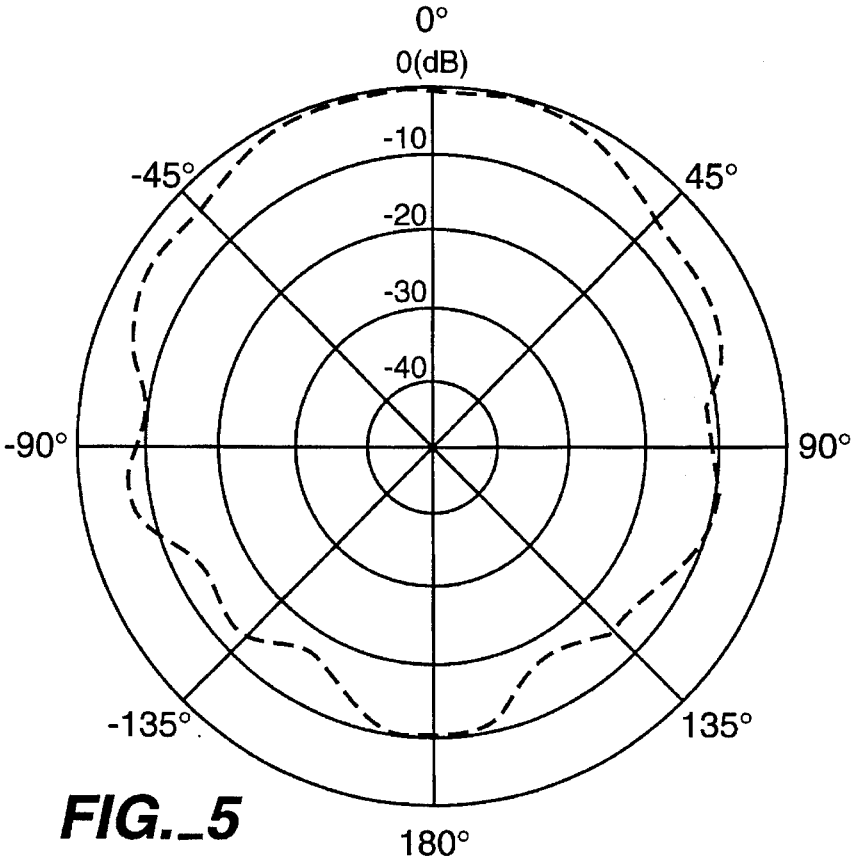
FIG. 5 shows the directional characteristic of the antenna unit of FIGS. 4A and 4B.
Figure 6A:
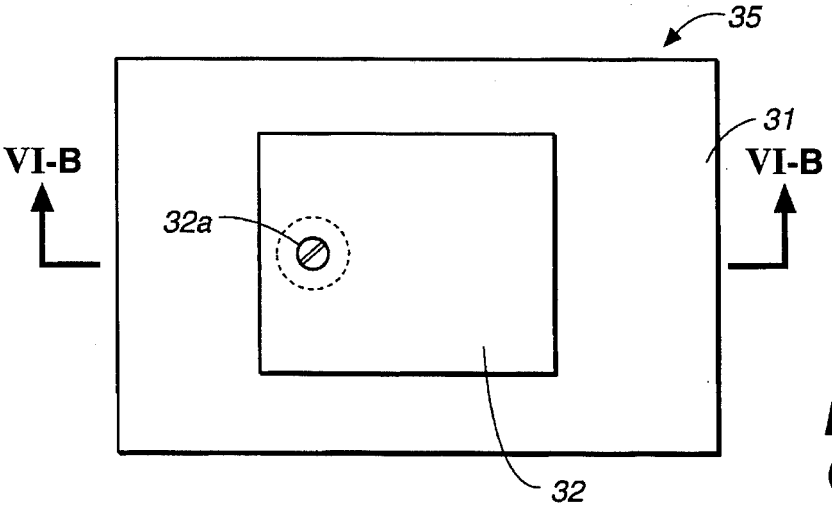
FIG. 6A (PRIOR ART)
FIG. 6 is a plan view of a prior art antenna and FIG. 6B is its sectional view taken along line VI–B–VI–B of FIG. 6A.
Figure 6B:
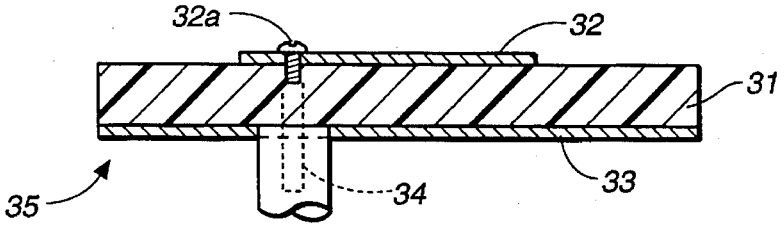
FIG. 6B (PRIOR ART)

As a practical example, an antenna unit as described above has been produced with a dielectric base plate of width 8 mm, length 12 mm and thickness 1 mm, a chip capacitor of 1 pF, and a metallic chassis of width 6.3 mm, length 10 mm and height 3 mm, having an antenna of resonance frequency 1.9 GHz attached to a printed circuit board of width 60 mm, length 90 mm and thickness 0.8 mm. Its directional characteristic is shown in FIG. 5, indicating that a maximum gain as high as −1dB was obtained although the maximum length of the antenna was only 1/16 of the wavelength. It is also to be appreciated that the maximum height of the antenna from its printed circuit board was only 2.2 mm.

Although this invention has been described above with reference to only a limited number of examples, they are not intended to limit the scope of the invention. Many variations and modifications are possible within the scope of the invention. For example, use may be made of a metallic chassis without protrusions of the kind shown at 15*a*, 15*b* and 15*c* in FIG. 2 by directly soldering its attachment parts 13 and 14 to the input electrode 2, the connector electrode 3 and the connecting area 4*b*. As another example, the electrostatic capacitance between the connector electrode 3 and the connecting area 4*c* need not be supplied by a chip capacitor, but may be realized by a floating capacity therebetween. The resonance frequency of the antenna 18 can be lowered by using a chip capacitor with large capacitance. Alternatively, the antenna 18 can be made more compact by keeping the resonant frequency about the same.

In summary, antennas and antenna units according to the present invention can be made compact because a metallic radiating part 12 is used to reduce its resistance and to increase its heat capacity such that its gain is improved. Since the antenna is surface-mounted by inserting its metallic chassis into an opening provided to a printed circuit board, furthermore, the height of the antenna by which it protrudes from the printed circuit board can be reduced. Moreover, the inductance between its input part and grounding electrode can be easily adjusted by varying the shape of the indentation in the metallic chassis for the antenna such that impedance matching of the antenna with an external circuit can be easily performed for reducing its reflection loss.

What is claimed is:

1. An antenna comprising:

a dielectric base plate;

an input electrode, a connector electrode and a plurality of grounding areas formed on said dielectric base plate; and a metallic chassis having a planar part, a first attachment part and a second attachment part, said first and second attachment parts being at mutually opposite edges of said planar part, said first attachment part having two mutually separated connecting members which are individually connected to said input electrode and one of said grounding areas, said second attachment part being connected to said connector electrode.

2. The antenna of claim 1 wherein said dielectric base plate is formed with throughholes therethrough, said input electrode, said connector electrode and one of said grounding areas each abutting one of said throughholes, said two connecting members protruding perpendicularly to said planar part, said two connecting members being each inserted into one of said through-holes.

3. The antenna of claim 1 wherein said attachment parts are planar, said input electrode, said connector electrode, and said grounding conductor being each directly soldered to either of said attachment parts.

4. The antenna of claim 1 wherein said first attachment part has an indentation formed on an edge thereof between said two connecting members.

5. The antenna of claim 1 further comprising a capacitor directly connected between said connector electrode and one of said grounding areas.

6. The antenna of claim 5 wherein said capacitor is a chip capacitor.

7. The antenna of claim 1 adapted to generate a floating capacity between said connector electrode and one of said ground areas.

8. The antenna of claim 1 wherein the inductance of said first attachment part between said two connecting members is adjusted for impedance matching of said antenna with an external circuit.

9. The antenna of claim 1 wherein said input electrode, said connector electrode and said grounding areas are formed on one surface of said dielectric base plate.

10. An antenna unit comprising;

a dielectric base plate;

an input electrode, a connector electrode and a plurality of grounding areas formed on said dielectric base plate;

a metallic chassis having a planar part, a first attachment part and a second attachment part, said first and second attachment parts being at mutually opposite edges of said planar part, said first attachment part having two mutually separated connecting members which are individually connected to said input electrode and one of said grounding areas, said second attachment part being connected to said connector electrode;

a circuit board having an opening therethrough; and a feed electrode and a grounding electrode formed on said circuit board, each having an edge which abuts said opening, said metallic chassis being inserted into said opening and thereby mounted to said circuit board, said input electrode being connected to said feed electrode, and said grounding electrode being connected to one of said grounding areas.

11. The antenna unit of claim 10 wherein said dielectric base plate is formed with throughholes therethrough, said input electrode, said connector electrode and one of said grounding areas each abutting one of said throughholes, said two connecting members protruding perpendicularly to said planar part, said two connecting members being each inserted into one of said through-holes.

12. The antenna unit of claim 10 wherein said first attachment part has an indentation formed on an edge thereof between said two connecting members.

13. The antenna unit of claim 10 further comprising a capacitor directly between said connector electrode and another of said grounding areas.

14. The antenna unit of claim 10 wherein the inductance of said first attachment part between said two connecting members is adjusted for impedance matching of said antenna unit with an external circuit.

15. The antenna unit of claim 10 wherein said input electrode, said connector electrode and said grounding areas formed on one surface of said dielectric base plate.

16. An antenna unit comprising;

a dielectric base plate;

an input electrode, a connector electrode and one or more grounding areas formed on said dielectric base plate;

a metallic chassis having a planar part and attachment parts formed at edge parts of said planar part, said input electrode, said connector electrode and said grounding area being each connected to either of said attachment parts;

a circuit board having an opening therethrough; and a feed electrode and a grounding electrode formed on said circuit board, said grounding electrode having an edge which abuts said opening, said feed electrode having an edge abutting a portion of said opening where said grounding electrode is not formed, said metallic chassis being inserted into said opening and thereby mounted to said circuit board, said input electrode being connected to said feed electrode, and said grounding electrode being connected to said grounding area.

17. The antenna unit of claim 16 wherein said dielectric base plate is formed with throughholes therethrough, said input electrode, said connector electrode and said grounding areas each abutting one of said throughholes, said attachment parts having protrusions protruding perpendicularly to said planar part, said protrusions being each inserted into one of said throughholes.

18. The antenna unit of claim 16 wherein one of said attachment parts has an indentation formed on an edge thereof between a first position where said input electrode is connected and a second position where said grounding area is connected.

19. The antenna unit of claim 16 further comprising a capacitor connected between said connector electrode and one of said grounding areas.

* * * * *